US010344778B2

(12) United States Patent
Chaudhry et al.

(10) Patent No.: US 10,344,778 B2
(45) Date of Patent: Jul. 9, 2019

(54) EJECTOR FOR A SEALED SYSTEM

(71) Applicant: General Electric Company, Schenectady, NY (US)

(72) Inventors: Gunaranjan Chaudhry, Bangalore (IN); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 454 days.

(21) Appl. No.: 15/055,678

(22) Filed: Feb. 29, 2016

(65) Prior Publication Data

US 2017/0248160 A1 Aug. 31, 2017

(51) Int. Cl.

| | |
|---|---|
| ***F04F 5/04*** | (2006.01) |
| ***F04F 5/46*** | (2006.01) |
| ***F24F 1/022*** | (2019.01) |
| ***F25B 13/00*** | (2006.01) |
| ***F25B 31/00*** | (2006.01) |

(52) U.S. Cl.

CPC ..... *F04F 5/463* (2013.01); *F04F 5/04* (2013.01); *F24F 1/022* (2013.01); *F25B 13/00* (2013.01); *F25B 31/00* (2013.01)

(58) Field of Classification Search

CPC ... F15D 1/02; F15D 1/025; G01F 1/42; G01F 1/44; B05B 7/416; B05B 7/066; F04F 5/02; F04F 5/04; F04F 5/463; F04F 5/14; F24F 1/022; F25B 13/00; F25B 31/00

USPC ..... 417/76, 79, 87, 151, 198, 77, 158, 196, 417/431; 239/398, 399, 416.4, 416.5, 239/417.5

See application file for complete search history.

(56) References Cited

U.S. PATENT DOCUMENTS

| | | | | | |
|---|---|---|---|---|---|
| 284,962 | A * | 9/1883 | Huston | F04F 5/46 | 417/197 |
| 807,251 | A * | 12/1905 | Davidson et al. | B01F 5/0428 | 261/76 |
| 2,733,105 | A * | 1/1956 | Williams | F04F 5/46 | 406/194 |
| 3,304,006 | A * | 2/1967 | Adams | F04D 31/00 | 237/67 |
| 3,838,002 | A * | 9/1974 | Gluntz | F04F 5/10 | 261/DIG. 75 |
| 4,041,981 | A * | 8/1977 | Davis | C02F 1/763 | 261/64.1 |
| 4,575,284 | A * | 3/1986 | Kelm | A01C 7/082 | 111/34 |
| 5,343,711 | A * | 9/1994 | Kornhauser | F25B 1/06 | 417/198 |
| 6,227,770 | B1 * | 5/2001 | Poncelet | A01C 7/082 | 406/195 |
| 7,128,278 | B2 * | 10/2006 | Archambeau | A01G 25/00 | 239/8 |
| 7,178,359 | B2 * | 2/2007 | Oshitani | F25B 5/00 | 62/500 |

(Continued)

*Primary Examiner* — Alexander B Comley
*Assistant Examiner* — Benjamin Doyle
(74) *Attorney, Agent, or Firm* — Dority & Manning, P.A.

(57) ABSTRACT

An ejector for a sealed system includes a motive liquid passage with a converging section, a throat and a diverging section. The throat of the motive liquid passage is disposed between the converging section of the motive liquid passage and the diverging section of the motive liquid passage. The ejector also includes a plurality of nucleation sites at the converging section of the motive liquid passage.

20 Claims, 4 Drawing Sheets

(56) References Cited

U.S. PATENT DOCUMENTS

| | | | | |
|---|---|---|---|---|
| 2003/0145613 | A1* | 8/2003 | Sakai | F04F 5/04 62/191 |
| 2010/0175422 | A1* | 7/2010 | Yamada | F25B 41/00 62/512 |
| 2011/0088413 | A1* | 4/2011 | Lampe | C09K 5/066 62/68 |
| 2011/0229346 | A1* | 9/2011 | Kim | F04F 5/20 417/171 |
| 2013/0167566 | A1* | 7/2013 | Alahyari | F25B 41/00 62/115 |
| 2016/0195316 | A1* | 7/2016 | Liu | F04F 5/461 239/417.5 |

* cited by examiner

EJECTOR FOR A SEALED SYSTEM

FIELD OF THE INVENTION

The present subject matter relates generally to ejectors for sealed systems, such as packaged terminal air conditioner units.

BACKGROUND OF THE INVENTION

Certain heat pump systems include a sealed system for chilling and/or heating air with refrigerant. The sealed systems generally include a throttling device for restricting a flow of refrigerant between an outdoor heat exchanger or coil and an indoor heat exchanger or coil of the sealed system. Various throttling devices are available, including capillary tubes, J-T valves, electronic expansion valves, etc. Within the throttling device, at least a portion of the refrigerant within the flow of refrigerant may vaporize.

Packaged terminal air conditioner units generally include a casing and a sealed system. Due to space constraints within the casing, selection of sealed system components for packaged terminal air conditioner units can be limited. For example, relatively small heat exchangers are generally used in packaged terminal air conditioner units due to space constraints within the casing. Utilizing small heat exchangers can result in a large pressure drop across the low pressure side heat exchanger and thereby negatively affect an efficiency of the packaged terminal air conditioner unit. To reduce such pressure drops, certain small heat exchangers include large diameter tubes and/or split refrigerant flow into multiple parallel tubes. However, such small heat exchangers reduce refrigerant velocity through the small heat exchangers and the refrigerant side heat transfer coefficient.

Accordingly, a device for reducing a pressure drop of refrigerant across a heat exchanger of the packaged terminal air conditioner unit would be useful. In particular, a device for reducing a pressure drop of refrigerant across a heat exchanger of a packaged terminal air conditioner unit without significantly reducing the refrigerant side heat transfer coefficient would be useful.

BRIEF DESCRIPTION OF THE INVENTION

The present subject matter provides an ejector for a sealed system. The ejector includes a motive liquid passage with a converging section, a throat and a diverging section. The throat of the motive liquid passage is disposed between the converging section of the motive liquid passage and the diverging section of the motive liquid passage. The ejector also includes a plurality of nucleation sites at the converging section of the motive liquid passage. Additional aspects and advantages of the invention will be set forth in part in the following description, or may be apparent from the description, or may be learned through practice of the invention.

In a first exemplary embodiment, an ejector for a sealed system is provided. The ejector includes an ejector body integrally formed of a unitary piece of material. The ejector body defines a suction gas passage and a motive liquid passage. The motive liquid passage of the ejector body includes a converging section, a throat and a diverging section. The throat of the motive liquid passage is disposed between the converging section of the motive liquid passage and the diverging section of the motive liquid passage. The ejector body also defines a plurality of nucleation sites at the converging section of the motive liquid passage.

In a second exemplary embodiment, an ejector for a sealed system is provided. The ejector includes an ejector body defining a mixing chamber and a nozzle disposed within ejector body proximate the mixing chamber of the ejector body. The nozzle defines a motive liquid passage. The motive liquid passage of the nozzle has a converging section, a throat and a diverging section. The throat of the motive liquid passage is disposed between the converging section of the motive liquid passage and the diverging section of the motive liquid passage. The nozzle also defines a plurality of nucleation sites at the converging section of the motive liquid passage.

In a third exemplary embodiment, a method for forming a unitary ejector of a sealed system is provided. The method includes establishing three-dimensional information of the unitary ejector, converting the three-dimensional information from the step of establishing into a plurality of slices and additively forming each slice of the unitary ejector. After the step of additively forming, the unitary ejector includes an ejector body that defines a suction gas passage and a motive liquid passage. The motive liquid passage of the ejector body has a converging section, a throat and a diverging section. The throat of the motive liquid passage is disposed between the converging section of the motive liquid passage and the diverging section of the motive liquid passage. The ejector body also defines a plurality of nucleation sites at the converging section of the motive liquid passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
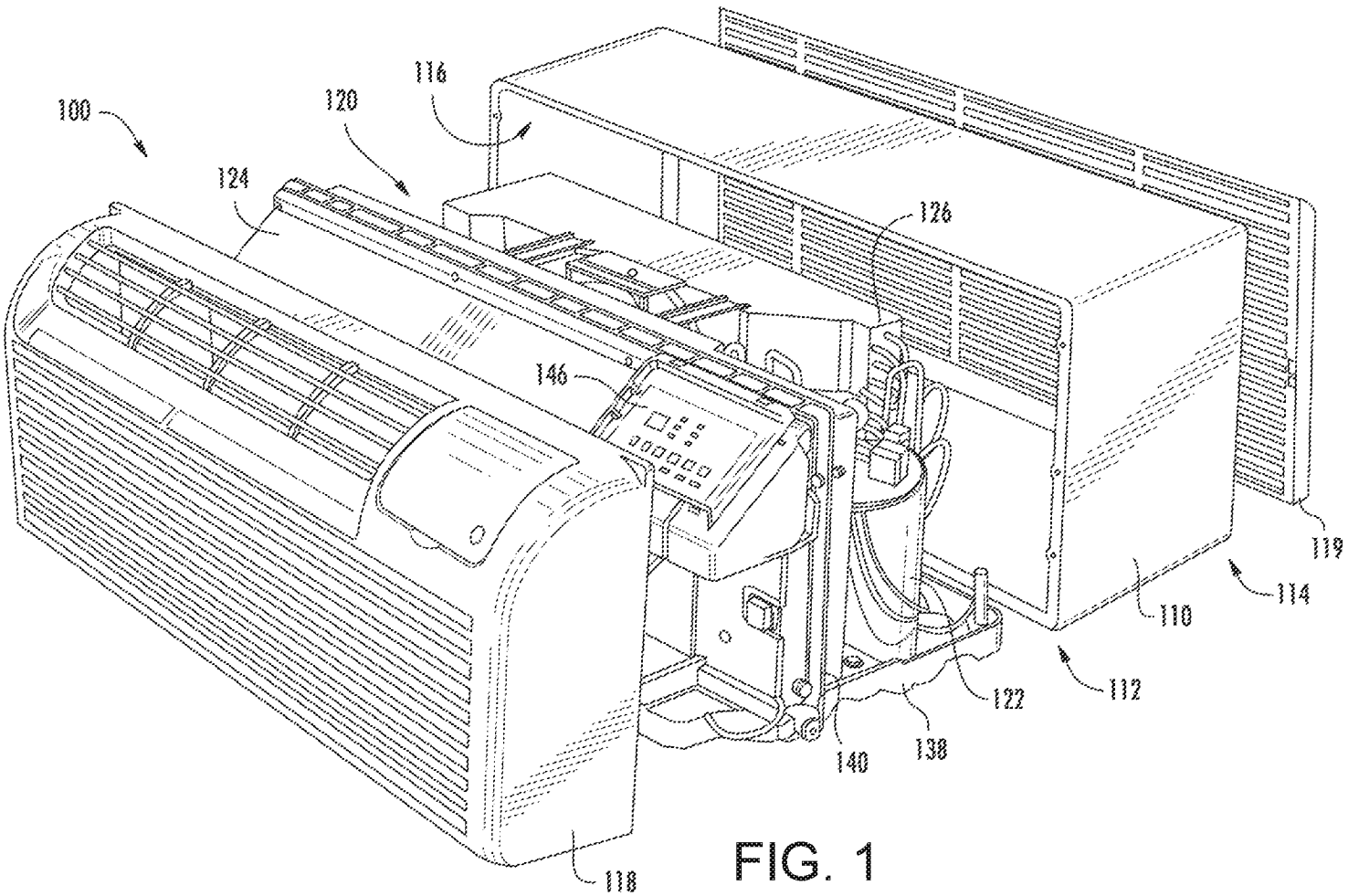
FIG. 1 provides an exploded perspective view of a packaged terminal air conditioner unit according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an exemplary embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 are mounted to casing 110 and hinder or limit access to mechanical compartment 116 of casing 110. Front panel 118 is mounted to casing 110 at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall 140 positioned within mechanical compartment 116 of casing 110. Sealed system 120 is positioned on bottom tray 138. Thus, liquid runoff from sealed system 120 may flow into and collect within bottom tray 138. Inner wall 140 may be mounted to bottom tray 138 and extend upwardly from bottom tray 138 to a top wall of casing 110. Inner wall 140 limits or prevents air flow between interior side portion 112 of casing 110 and exterior side portion 114 of casing 110 within mechanical compartment 116 of casing 110. Thus, inner wall 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
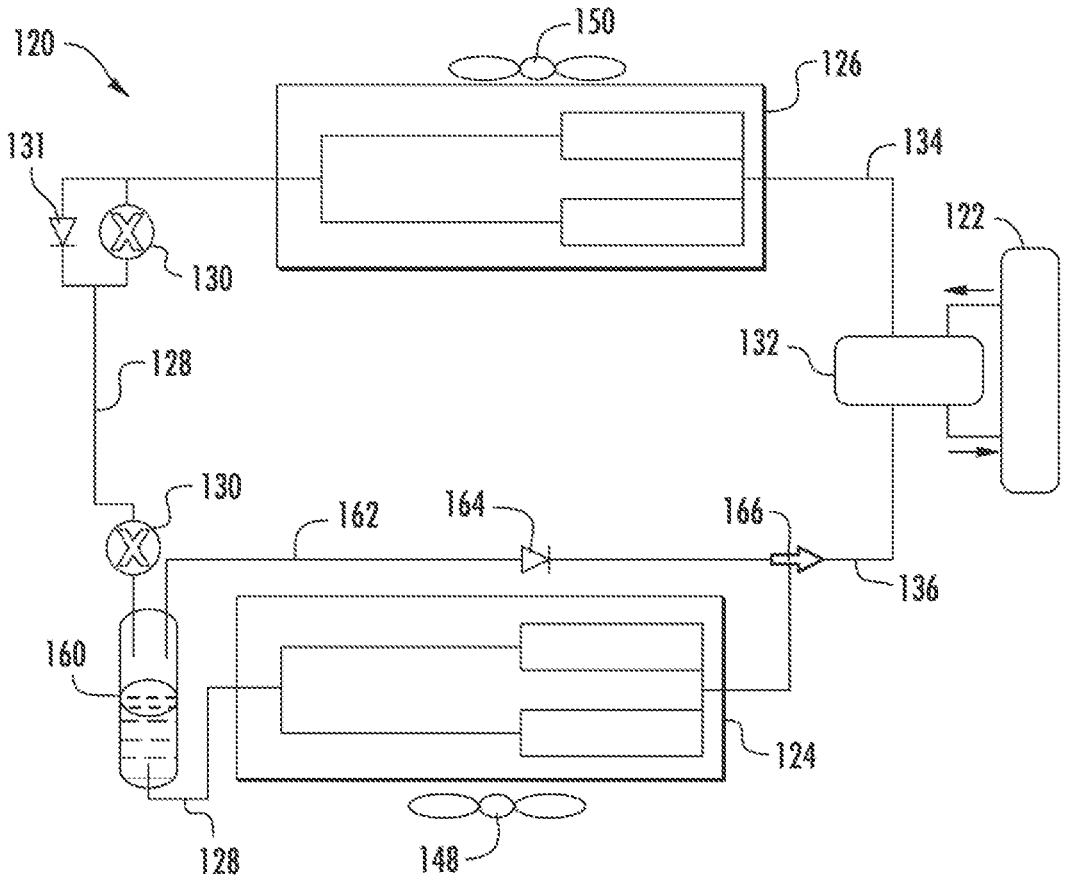
FIG. 2 provides a schematic view of certain components of the exemplary packaged terminal air conditioner unit of FIG. 1.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 also includes a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor and/or high quality vapor mixture. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 150 is positioned adjacent exterior coil 126 may facilitate or urge a flow of air from the exterior atmosphere across exterior coil 126 in order to facilitate heat transfer.

Sealed system 120 also includes a supply conduit 128 disposed between interior coil 124 and exterior coil 126, e.g., such that supply conduit 128 extends between and fluidly couples interior coil 124 and exterior coil 126.

Refrigerant, which may be in the form of high liquid quality/saturated liquid vapor mixture, may exit exterior coil 126 and travel through supply conduit 128 before flowing through interior coil 124. The refrigerant may then be flowed through interior coil 124.

Supply conduit 128 may generally expand the refrigerant, lowering the pressure and temperature thereof. Thus, supply conduit 128 may function as a throttling device for sealed system 120. Supply conduit 128 may include various components for throttling refrigerant flow through supply conduit 128. For example, in the exemplary embodiment shown in FIG. 2, supply conduit 128 includes a pair of expansion valves 130 and a check valve 131 for throttling refrigerant flow through supply conduit 128. In alternative exemplary embodiments, sealed system 120 may include any other suitable device or mechanism for throttling the flow of refrigerant through supply conduit 128. For example, sealed system 120 may include a capillary tube and check valve, a J-T valve, an electronic expansion valve, etc. coupled to supply conduit 128 in order to throttle the flow of refrigerant through supply conduit 128, as will be understood by those skilled in the art.

Interior coil 124 is disposed downstream of supply conduit 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. Within interior coil 124, the refrigerant from supply conduit 128 receives energy from the interior atmosphere and vaporizes into superheated vapor and/or high quality vapor mixture. An interior air handler or fan 148 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of supply conduit 128 in the heating mode and acts as an evaporator, e.g., such that exterior coil 126 is operable to heat refrigerant within exterior coil 126 with energy from the exterior atmosphere at exterior side portion 114 of casing 110.

As discussed above, when the refrigerant enters supply conduit 128, refrigerant is mostly liquid and is typically subcooled below the saturation temperature. As the refrigerant flows through supply conduit 128, the refrigerant static pressure decreases and refrigerant vapor bubbles form. As may be seen in FIG. 2, sealed system 120 includes a phase separator 160. Phase separator 160 is configured for separating liquid refrigerant within phase separator 160 from vapor refrigerant within phase separator 160. By separating liquid refrigerant from vapor refrigerant, phase separator 160 may improve a performance and/or efficiency of packaged terminal air conditioner unit 100, as discussed in greater detail below.

As may be seen in FIG. 2, phase separator 160 is coupled to supply conduit 128 at or adjacent interior coil 124. In particular, phase separator 160 may be positioned at or adjacent interior coil 124 within casing 110. Phase separator 160 receives refrigerant from supply conduit 128 and separates liquid refrigerant from supply conduit 128 from vapor refrigerant from supply conduit 128. The liquid phase refrigerant within phase separator 160 is directed from phase separator 160 to interior coil 124 via supply conduit 128. Conversely, the vapor phase refrigerant is directed around interior coil 124 such that the vapor phase refrigerant bypasses interior coil 124, as discussed in greater detail below.

Sealed system 120 includes a bypass conduit 162 for directing vapor phase refrigerant from phase separator 160 around interior coil 124. As may be seen in FIG. 2, bypass conduit 162 extends from phase separator 160 around interior coil 124, e.g., to second distribution conduit 136. Thus, vapor phase refrigerant within phase separator 160 may flow through bypass conduit 162 around interior coil 124 to second distribution conduit 136, e.g., when sealed system 120 is operating in the cooling mode. A bypass check valve 164 is coupled to bypass conduit 162. Bypass check valve 164 is configured for limiting or preventing refrigerant from flowing from second distribution conduit 136 to phase separator 160 around interior coil 124, e.g., when sealed system 120 in the heating mode.

To facilitate reintroduction of the vapor phase refrigerant from phase separator 160 into second distribution conduit 136, sealed system 120 may include an injector or ejector 166, e.g., configured for combining streams of refrigerant via the Venturi effect. Ejector 166 is positioned at a junction between bypass conduit 162 and second distribution conduit 136. Ejector 166 receives the vapor phase refrigerant from bypass conduit 162 and directs or urges the vapor phase refrigerant into second distribution conduit 136 and refrigerant flowing through second distribution conduit 136.

Ejector 166 may generate a resistance to refrigerant flow upstream from ejector 166 within bypass conduit 162. The resistance of ejector 166 may allow for or provide a balance in the pressure drops across bypass conduit 162 and across interior coil 124, e.g., such that the pressure drops across such components are equal or about (e.g., within ten percent of each other) equal. To provide such balance in pressure drops, bypass conduit 162 may have a smaller diameter than tubing within interior coil 124 and have a suitable length, as will be understood by those skilled in the art.

It should be understood that phase separator 160 may be any suitable type of phase separator. Within a casing of phase separator 160, liquid phase refrigerant may collect or pool at a bottom portion of phase separator 160 and vapor phase refrigerant may collect or pool at a top portion of phase separator 160, e.g., due to density differences between the liquid and vapor phase refrigerants.

By directing vapor phase refrigerant around interior coil 124, a performance and/or efficiency of packaged terminal air conditioner unit 100 may be improved or increased. For example, at an entrance of the interior coil, refrigerant may be approximately twenty to thirty percent vapor by mass in previous packaged terminal air conditioner units. By volume however, the refrigerant is mostly vapor at the entrance of the interior coil because the vapor specific volume is many times larger than that of the liquid refrigerant. By providing phase separator 160 and separating liquid refrigerant from vapor refrigerant as described above, the velocity of refrigerant entering interior coil 124 may be greatly decreased. Such reduction in refrigerant velocity at the inlet of interior coil 124 may reduce a pressure drop across interior coil 124 without a significant reduction in cooling, e.g., because the quantity of liquid refrigerant is unchanged. In particular, phase separator 160 may reduce the pressure drop across interior coil 124 by more than fifty percent while only causing a small reduction in heat transfer. In such a manner, the efficiency of packaged terminal air conditioner unit 100 may be increased by five percent by providing phase separator 160 within sealed system 120 of packaged terminal air conditioner unit 100. In addition, ejector 166 utilizes relatively high-pressure flow in bypass conduit 162 to increase the pressure of vapor exiting indoor coil 124 in order to increase compressor suction pressure and further improve efficiency of packaged terminal air conditioner unit 100.

Figure 3:
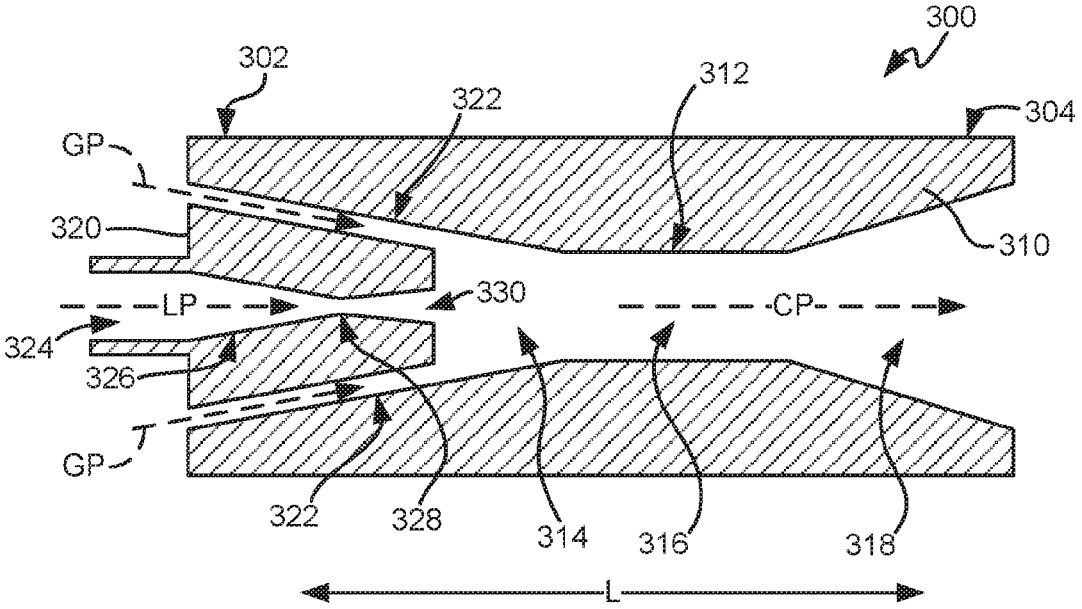
FIG. 3 provides a section view of an ejector according to an exemplary embodiment of the present subject matter.

FIG. 3 provides a section view of an ejector 300 according to an exemplary embodiment of the present subject matter. Ejector 300 may be used in or with any suitable sealed system. For example, ejector 300 may be used in sealed system 120 as ejector 166 (FIG. 2). Thus, ejector 300 is discussed in greater detail below in the context of sealed system 120. Ejector 300 includes features for assisting combining streams of vapor phase refrigerant and liquid phase refrigerant.

It should be understood that the present subject matter may be used in or with any other suitable packaged terminal air conditioner unit in alternative exemplary embodiments. For example, the present subject matter may be used in or with the packaged terminal air conditioner unit described in U.S. patent application Ser. No. 14/691,612 of Chaudhry et al, which is hereby incorporated by reference for all purposes. As another example, the present subject matter may be used in or with the packaged terminal air conditioner unit described in U.S. patent application Ser. No. 14/790,204 of Chaudhry et al, which is hereby incorporated by reference for all purposes.

As shown in FIG. 3, ejector 300 defines a longitudinal direction L. Ejector 300 extends between a first end portion 302 and a second end portion 304, e.g., along the longitudinal direction L. Thus, first and second end portions 302 and 304 of ejector 300 are spaced apart from each other, e.g., along the longitudinal direction L. A stream of liquid phase refrigerant LP and a stream of gaseous phase refrigerant GP enter ejector 300 at or adjacent first end portion 302 of ejector 300, and a combined stream of refrigerant CP exits ejector 300 at or adjacent second end portion 304 of ejector 300.

Ejector 300 also includes an ejector body 310 and a nozzle 320. Ejector body 310 and nozzle 320 may be formed of or with common piece of material, such as metal or plastic, in certain exemplary embodiments. For example, ejector body 310 and nozzle 320 may be integrally formed of a single continuous piece of metal or plastic. In alternative exemplary embodiments, ejector body 310 and nozzle 320 may be formed of or with separate pieces of material, such as metal or plastic, that are mounted to each other to form ejector 300.

Ejector body 310, e.g., an inner surface of ejector body 310, defines a mixing chamber 312. Mixing chamber 312 includes a converging section 314, a throat 316 and a diverging section 318 that are distributed or spaced apart from one another, e.g., along the longitudinal direction L. Diverging section 318 of mixing chamber 312 may be positioned at or adjacent second end portion 304 of ejector 300, and converging section 314 and throat 316 of mixing chamber 312 may be positioned upstream of diverging section 318 of mixing chamber 312 relative to the combined stream of refrigerant CP. Throat 316 of mixing chamber 312 may also be disposed between converging section 314 and diverging section 318 of mixing chamber 312 along the longitudinal direction L. Nozzle 320 may also be positioned at or adjacent converging section 314 of mixing chamber 312 (e.g., at or adjacent first end portion 302 of ejector 300).

Converging section 314 of mixing chamber 312 tapers towards and directs refrigerant into throat 316 of mixing chamber 312. Conversely, diverging section 318 of mixing chamber 312 expands from and directs refrigerant out of throat 316 of mixing chamber 312. As refrigerant flows through converging section 314 of mixing chamber 312 into throat 316 of mixing chamber 312, the refrigerant increases in velocity and decreases in static pressure. Conversely, the refrigerant decreases in velocity and increases in static pressure as the refrigerant flows through diverging section 318 of mixing chamber 312 from throat 316 of mixing chamber 312. Such velocity and pressure changes can assist with mixing of the stream of liquid phase refrigerant LP and the stream of gaseous phase refrigerant GP within mixing chamber 312.

Ejector body 310 and/or nozzle 320 also define features for directing the stream of liquid phase refrigerant LP and the stream of gaseous phase refrigerant GP into mixing chamber 312. For example, ejector body 310 and/or nozzle 320 may define a plurality of suction gas passages 322 and a motive liquid passage 324. For example, ejector body 310 and nozzle 320 may define suction gas passages 322 therebetween, and nozzle 320 (e.g., an inner surface of nozzle 320) may define motive liquid passage 324 therein. Suction gas passages 322 are configured for receiving the stream of gaseous phase refrigerant GP and directing the stream of gaseous phase refrigerant GP into mixing chamber 312. Similarly, motive liquid passage 324 is configured for receiving the stream of liquid phase refrigerant LP and directing the stream of liquid phase refrigerant LP into mixing chamber 312.

As shown in FIG. 3, suction gas passages 322 may be disposed about motive liquid passage 324. In particular, suction gas passages 322 may be, e.g., uniformly, circumferentially distributed about motive liquid passage 324. Suction gas passages 322 may include any suitable number of passages. For example, suction gas passages 322 may include at least two passages, at least three passages, at least four passages or more passages. In certain exemplary embodiments, ejector 300 may include only one suction gas passage 322.

Ejector 300 includes various features for assisting with mixing the stream of liquid phase refrigerant LP with the stream of gaseous phase refrigerant GP. As shown in FIG. 3, motive liquid passage 324 includes a converging section 326, a throat 328 and a diverging section 330 that are distributed or spaced apart from one another, e.g., along the longitudinal direction L. Converging section 326 of motive liquid passage 324 may be positioned at or adjacent first end portion 302 of ejector 300, and diverging section 330 and throat 328 of motive liquid passage 324 may be positioned downstream of converging section 326 of motive liquid passage 324 relative to the stream of liquid refrigerant LP. Throat 328 of motive liquid passage 324 may also be disposed between converging section 326 and diverging section 330 of motive liquid passage 324 along the longitudinal direction L.

Converging section 326 of motive liquid passage 324 tapers towards and directs liquid refrigerant towards throat 328 of motive liquid passage 324. Conversely, diverging section 330 of motive liquid passage 324 expands from and directs refrigerant out of throat 328 of motive liquid passage 324. At throat 328 of motive liquid passage 324, a velocity of the refrigerant may be no less than a sonic velocity of the refrigerant. Similarly, the refrigerant may be at a supersonic velocity in the diverging section 330 of motive liquid passage 324.

As liquid refrigerant flows through converging section 326 of motive liquid passage 324 into throat 328 of motive liquid passage 324, the liquid refrigerant decreases in static pressure, e.g., due to increasing velocity of the liquid refrigerant and/or friction with nozzle 320, and an equilibrium state of the refrigerant in converging section 326 of motive liquid passage 324 is two phase liquid with vapor bubbles. However, formation of the vapor bubbles within converging section 326 of motive liquid passage 324 takes time. Thus, ejector 300 includes features for assisting the refrigerant within converging section 326 of motive liquid passage 324 to achieve equilibrium vapor quality in converging section 326 of motive liquid passage 324. Without such features, the refrigerant within converging section 326 of motive liquid passage 324 may pass into throat 328 of motive liquid passage 324 without completely forming vapor bubbles due to the high velocity of the refrigerant within converging section 326 of motive liquid passage 324. By facilitating vapor bubble formation within converging section 326 of motive liquid passage 324, the velocity of refrigerant in diverging section 330 of motive liquid passage 324 may be increased (e.g., maximized) and drawing or entraining of the stream of gaseous phase refrigerant GP into mixing chamber 312 by refrigerant exiting diverging section 330 of motive liquid passage 324 may be facilitated.

Figure 4:
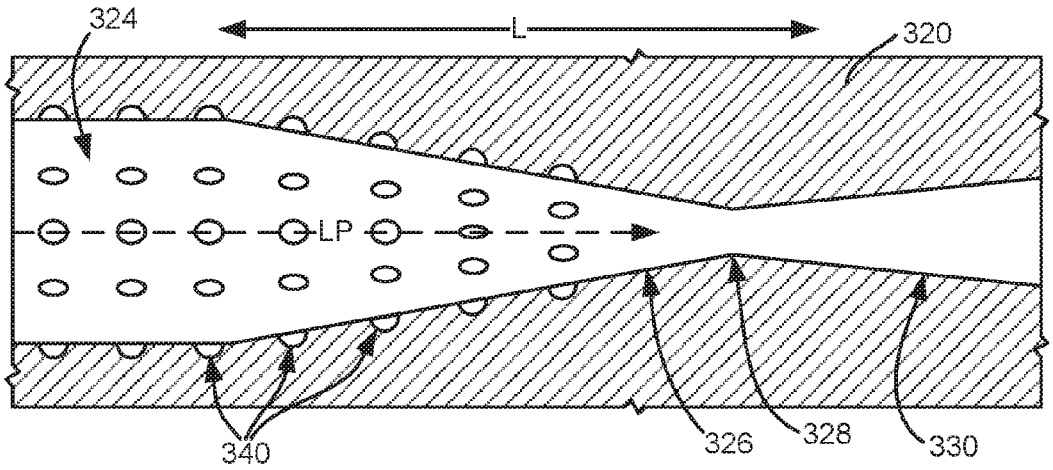
FIGS. 4-6 provide section views of nozzles with nucleation sites according to various exemplary embodiments of the present subject matter.
Figure 5:
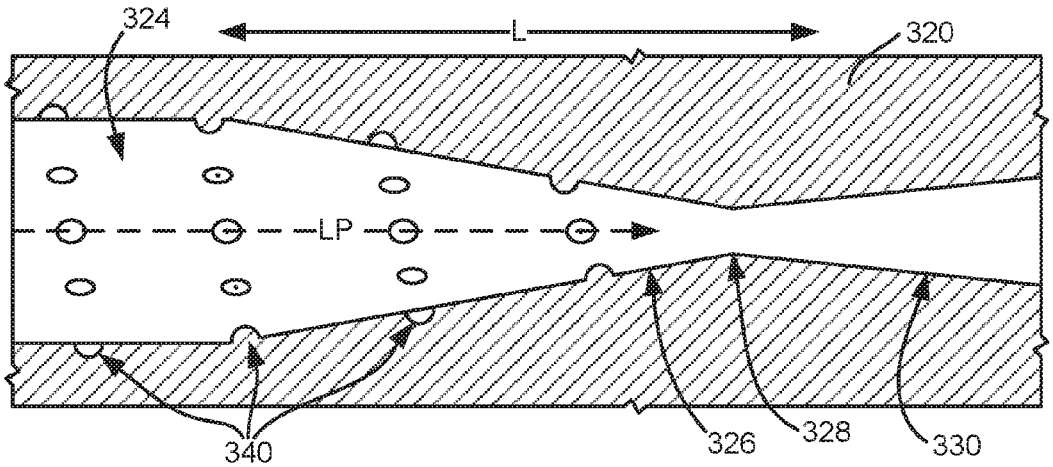
Figure 6:
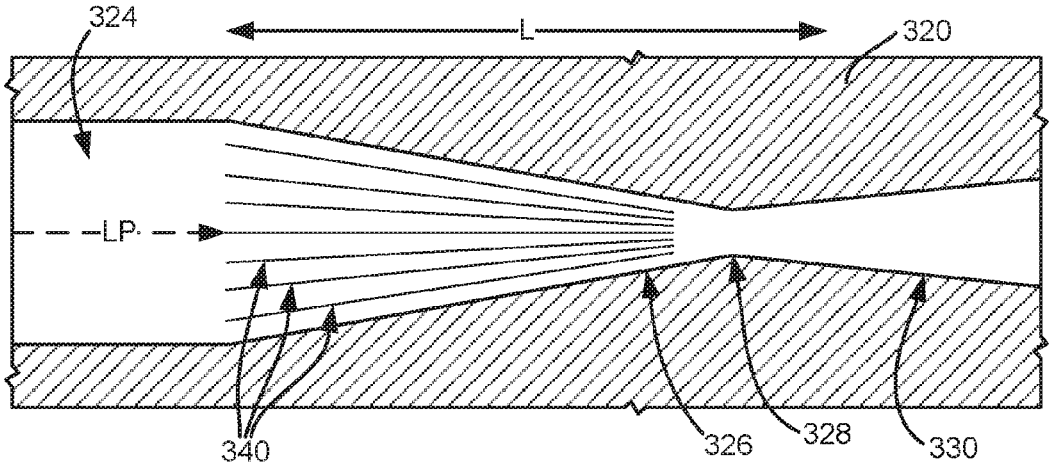

FIGS. 4-6 provide section views of nozzle 320 of ejector 300 with various exemplary features for facilitating vapor bubble formation. As shown in FIGS. 4-6, ejector 300 includes a plurality of nucleation sites 340 at converging section 326 of motive liquid passage 324. Nucleation sites 340 facilitate formation of vapor bubbles within the refrigerant in converging section 326 of motive liquid passage 324. As used herein, the term "nucleation sites" corresponds to holes extending into the surface of converging section 326 of motive liquid passage 324, projections extending from the surface of converging section 326 of motive liquid passage 324 or a combination of such holes and projections. The vapor bubbles may seed the liquid-to-vapour mass transfer process for refrigerant within converging section 326 of motive liquid passage 324 and assist with shifting the refrigerant closer to a high-velocity equilibrium state before the refrigerant exits diverging section 330 of motive liquid passage 324 into mixing chamber 312. In such a manner, an efficiency of ejector 300 may be improved.

In FIGS. 4-6, various exemplary forms and distributions of nucleation sites 340 are illustrated. As shown in FIG. 4, nucleation sites 340 may be formed as dimples or holes that extend into nozzle 320 in certain exemplary embodiments. The dimples may be circular, oval, rectangular or have any other suitable shape. In addition, as shown in FIG. 4, nucleation sites 340 may be distributed (e.g., along the longitudinal direction L) or arranged in a plurality of circumferential rings at converging section 326 of motive liquid passage 324.

Turning now to FIG. 5, nucleation sites 340 may be formed as projections or bumps that extend from nozzle 320 (e.g., or a combination of projections and dimples) in certain exemplary embodiments. The projections may be circular, oval, rectangular or have any other suitable shape. In addition, as shown in FIG. 5, nucleation sites 340 may be distributed or arranged in a helical or spiral pattern at converging section 326 of motive liquid passage 324.

Turning now to FIG. 6, nucleation sites 340 may be formed as ribs on nozzle 320 in certain exemplary embodiments. The ribs may extend along the longitudinal direction L in converging section 326 of motive liquid passage 324. The ribs may have any suitable height from a surface of nozzle 220 into converging section 326 of motive liquid passage 324. For example, utilizing the additive formation methods described below, the ribs may be no greater than five hundredths of an inch tall or no greater than two hundredths of an inch tall. In certain exemplary embodiments, the height of the ribs may be one thickness of an associated powder layer, e.g., one thousandths of an inch, utilized during the additive formation process.

An exemplary method for forming the ejector 300 is discussed in greater detail below. It should be understood that the method may be used to form any other suitable ejector in alternative exemplary embodiments. The method described below assists with formation of various features of ejector 300, as discussed in greater detail below. The method may fabricate ejector 300 as a unitary ejector, e.g., such that ejector 300 is formed of a single continuous piece of plastic, metal or other suitable material.

Ejector 300 may be formed using an additive process, such as Fused Deposition Modeling (FDM), Selective Laser Sintering (SLS), Stereolithography (SLA), Digital Light Processing (DLP), Direct Metal Laser Sintering (DMLS), Laser Net Shape Manufacturing (LNSM), electron beam sintering and other known processes. An additive process fabricates plastic or metal components using three-dimensional information, for example a three-dimensional computer model, of the component. The three-dimensional information is converted into a plurality of slices, each slice defining a cross section of the component for a predetermined height of the slice. The component is then "built-up" slice by slice, or layer by layer, until finished.

Accordingly, a three-dimensional information of ejector 300 is determined. As an example, a model or prototype of ejector 300 may be scanned to determine the three-dimensional information of ejector 300. As another example, a model of ejector 300 may be constructed using a suitable CAD program to determine the three-dimensional information of ejector 300. The three-dimensional information is then converted into a plurality of slices that each defines a cross-sectional layer of ejector 300. As an example, the three-dimensional information may be divided into equal sections or segments, e.g., along a central (e.g., vertical) axis of ejector 300 or any other suitable axis. Thus, the three-dimensional information may be discretized, e.g., in order to provide planar cross-sectional layers of ejector 300.

Ejector 100 is then fabricated using the additive process, or more specifically each layer is successively formed, e.g., by fusing or polymerizing a plastic using laser energy or heat. The layers may have any suitable size. For example, each layer may have a size between about five ten-thousandths of an inch and about one thousandths of an inch. Ejector 300 may be fabricated using any suitable additive manufacturing machine. For example, any suitable laser sintering machine, inkjet printer or laserjet printer may be used.

Utilizing the above method, ejector 300 may have fewer components and/or joints than known ejectors. Specifically, ejector 300 may require fewer components because ejector 300 may be a single piece of continuous plastic or metal, e.g., rather than multiple pieces of plastic or metal joined or connected together. In addition, the method may permit formation of nucleation sites 340 at converging section 326 of motive liquid passage 324. As a result, ejector 300 may efficiently entrain the stream of gaseous phase refrigerant GP into mixing chamber 312 with the stream of liquid phase refrigerant LP. Also, ejector 300 may be less prone to leaks and/or be stronger when formed with in the manner described above.

Utilizing an additive process, nucleation sites 340 may also be formed with the surface finish of nozzle 320 at converging section 326 of motive liquid passage 324 rather than a defined feature. In particular, nucleation sites 340 may correspond to a surface finish more rough than an adjacent surface finish. During the additive process, the surface finish may be adjusted (e.g., made smoother or rougher) by selecting appropriate laser parameters during the additive process. A rougher finish may be achieved by increasing laser scan speed or a thickness of the powder layer, and a smoother finish may be achieved by decreasing laser scan speed or the thickness of the powder layer. The scanning pattern and/or laser power can also be changed to change the surface finish in a selected area at converging section 326 of motive liquid passage 324.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ejector for a sealed system, comprising an ejector body integrally formed of a unitary piece of material, the ejector body defining a suction gas passage and a motive liquid passage, wherein the motive liquid passage of the ejector body includes a converging section, a throat and a diverging section, the throat of the motive liquid passage disposed between the converging section of the motive liquid passage and the diverging section of the motive liquid passage, the ejector body also defining a plurality of nucleation sites at the converging section of the motive liquid passage, wherein the plurality of nucleation sites are confirmed to form vapor bubbles within a refrigerant flowing through the converging section of the motive liquid passage, and wherein each of the plurality of nucleation sites is formed by a discrete hole that extends into a surface of the converging section or a discrete projection that extends from the surface of the converging section.

2. The ejector of claim 1, wherein the plurality of nucleation sites comprises a plurality of dimples extending into the ejector body front the converging section of the motive liquid passage.

3. The ejector of claim 2, wherein the plurality of dimples are arranged in a plurality of circumferential rings at the converging section of the motive liquid passage.

4. The ejector of claim 2, wherein the plurality of dimples are arranged in a spiral pattern at the converging section of the motive liquid passage.

5. The ejector of claim 1, wherein the plurality of nucleation sites comprises a plurality of projections extending from the ejector body into the converging section of the motive liquid passage.

6. The ejector of claim 5, wherein the plurality of projections are arranged in a plurality of circumferential rings at the converging section of the motive liquid passage.

7. The ejector of claim 5, wherein the plurality of projections are arranged in a spiral pattern at the converging section of the motive liquid passage.

8. The ejector of claim 1, wherein the suction gas passage comprises a plurality of suction gas passages, wherein the plurality of suction gas passages are disposed around the motive liquid passage within the ejector body.

9. The ejector of claim 1, wherein each of the plurality of nucleation sites is formed by a discrete projection, wherein each of the discrete projections comprises a rib extending from the ejector body into the converging section of the motive liquid passage.

10. An ejector for a sealed system, comprising an ejector body defining a mixing chamber;

a nozzle disposed within the ejector body proximate the mixing chamber of the ejector body, the nozzle defining a motive liquid passage, the motive Liquid passage of the nozzle having a converging section, a throat and a diverging section, the throat of the motive liquid passage disposed between the converging section of the motive liquid passage and the diverging section of the motive liquid passage, the nozzle also defining a plurality of nucleation sites at the converging section of the motive liquid passage, wherein the plurality of nucleation sites are configured to form vapor, bubbles within a refrigerant flowing through the converging section of the motive liquid passage, and wherein each of the plurality of nucleation sites is formed by a discrete hole that extends into a surface of the converging section or a discrete projection that extends from the surface of the converging section.

11. The ejector of claim 10, wherein the plurality of nucleation sites comprises a plurality of dimples extending into the nozzle from the converging section of the motive liquid passage.

12. The ejector of claim 11, wherein the plurality of dimples are arranged in a plurality of circumferential rings at the converging section of the motive liquid passage.

13. The ejector of claim 12, wherein the plurality of dimples are arranged in a spiral pattern at the converging section of the motive liquid passage.

14. The ejector of claim 10, wherein the plurality of nucleation sites comprises a plurality of projections extending from the nozzle into the converging section of the motive liquid passage.

15. The ejector of claim 14, wherein the plurality of projections are arranged in a plurality of circumferential rings at the converging section of the motive liquid passage.

16. The ejector of claim 14, wherein the plurality of projections are arranged in a spiral pattern at the converging section of the motive liquid passage.

17. The ejector of claim 10, wherein the ejector body and the nozzle define a plurality of suction gas passages, wherein the plurality of suction gas passages are disposed around the motive liquid passage.

18. The ejector of claim 10, wherein each of the plurality of nucleation sites is formed by a discrete projection, wherein each of the discrete projections comprises a rib extending from the ejector body into the converging section of the motive liquid passage.

19. A method for forming a unitary ejector of a sealed system, comprising:

establishing three-dimensional information of the unitary ejector;

converting the three-dimensional information from said step of establishing into a plurality of slices; and additively forming each slice of the unitary ejector, wherein, after said step of additively forming, the unitary ejector comprises an ejector body defining a suction gas passage and a motive liquid passage, the motive liquid passage of the ejector body having a converging section, a throat and a diverging section, the throat of the motive liquid passage disposed between the converging section of the motive liquid passage and the diverging section of the motive liquid passage, the ejector body also defining a plurality of nucleation sites at the converging section of the motive liquid passage, wherein the plurality of nucleation sites are configured to form vapor bubbles within a refrigerant flowing through the converging section of the motive liquid passage, and wherein each of the plurality of nucleation sites a is formed by a discrete hole that extends into a surface of the converging section or a discrete projection that extends from the surface of the converging section.

20. The method of claim 19, wherein said step of additively forming comprises forming each slice of the unitary ejector with at least one of fused deposition modeling, selective laser sintering, stereolithography and digital light processing.

* * * * *